US010906779B2

(12) United States Patent
Simonatto Marques

(10) Patent No.: US 10,906,779 B2
(45) Date of Patent: Feb. 2, 2021

(54) RAIL FOOT HOLDER FOR FASTENING A RAIL OF AN ELEVATOR SYSTEM

(71) Applicant: Inventio AG, Hergiswil (CH)

(72) Inventor: Robson Simonatto Marques, Vargem Grande Paulista (BR)

(73) Assignee: INVENTIO AG, Hergiswil (CH)

( * ) Notice: Subject to any disclaimer, the term of this patent is extended or adjusted under 35 U.S.C. 154(b) by 62 days.

(21) Appl. No.: 16/466,654

(22) PCT Filed: Dec. 7, 2017

(86) PCT No.: PCT/EP2017/081795
§ 371 (c)(1),
(2) Date: Jun. 5, 2019

(87) PCT Pub. No.: WO2018/104435
PCT Pub. Date: Jun. 14, 2018

(65) Prior Publication Data

US 2020/0062547 A1 Feb. 27, 2020

(30) Foreign Application Priority Data

Dec. 7, 2016 (EP) ..... 16202634

(51) Int. Cl.
*B66B 7/02* (2006.01)
*B66B 19/00* (2006.01)

(52) U.S. Cl.
CPC ..... *B66B 7/024* (2013.01); *B66B 19/002* (2013.01)

(58) Field of Classification Search
CPC ..... B66B 7/024; B66B 19/002
See application file for complete search history.

(56) References Cited

U.S. PATENT DOCUMENTS 3,420,337 A * 1/1969 Magee ..... B66B 7/047 187/408
4,431,087 A * 2/1984 Karol ..... B66B 7/024 187/408
4,577,729 A * 3/1986 Karol ..... B66B 7/024 187/408

(Continued)

FOREIGN PATENT DOCUMENTS

DE 3010826 A1 10/1981
EP 0448839 A1 10/1991
ES 2421083 A1 8/2013

*Primary Examiner* — Michael A Riegelman
(74) *Attorney, Agent, or Firm* — William J. Clemens; Shumaker, Loop & Kendrick, LLP

(57) ABSTRACT

A rail foot holder for fastening a rail in an elevator shaft includes a contact body defining a contact plane and at least one holding device. A first side part of a rail foot arranged between a holding head of the holding device and the contact plane to fasten the rail. A holding dimension between the holding head and the contact plane can be changed to compensate tolerances of the first side part. The holding head can be rotated about an axis of rotation into a fastening position to reduce the holding dimension. A side of the holding head facing the contact plane has a slope against the direction of rotation in at least one fastening region extending around the axis of rotation in the direction of rotation, in which fastening region at least indirect contact between the holding head and the first side part is enabled.

15 Claims, 5 Drawing Sheets

(56) References Cited

U.S. PATENT DOCUMENTS

| | | | | |
|---|---|---|---|---|
| 6,413,005 | B1 * | 7/2002 | Massie | F16B 5/0216 403/334 |
| 7,389,940 | B2 * | 6/2008 | Kurzo | B66B 7/02 187/408 |
| 7,752,978 | B2 * | 7/2010 | Schroeder | F16C 29/005 104/245 |
| 8,939,264 | B2 * | 1/2015 | Sanz Gamboa | B66B 7/026 187/408 |
| 2012/0133164 | A1 * | 5/2012 | Sanz Gamboa | B66B 7/024 294/119.1 |
| 2017/0297867 | A1 * | 10/2017 | Fauconnet | B66B 7/023 |
| 2018/0370766 | A1 * | 12/2018 | Madureira De Almeida | B66B 7/024 |
| 2020/0062547 | A1 * | 2/2020 | Simonatto Marques | B66B 7/024 |

* cited by examiner

RAIL FOOT HOLDER FOR FASTENING A RAIL OF AN ELEVATOR SYSTEM

FIELD

The invention concerns a rail foot holder for fastening a rail of an elevator system in an elevator shaft, and a method for fastening a rail of an elevator system in an elevator shaft, preferably by means of a plurality of such rail foot holders.

BACKGROUND

From EP 0 448 839 A1 a fastening device for guide rails of elevators is of known art. The fastening device of known art allows an alteration in the preload force of a rail clamp. Such an alteration or adjustment of the preload force of the rail clamp is achieved in that a semicircular profile serving as a supporting chuck for the guide rail is able to have different thicknesses. Accordingly, however, it is necessary to determine which semicircular profile is required and must be delivered as part of the fastening device before the fastening device is assembled, and thus as a rule before the elevator system is installed.

When installing an elevator system in an elevator shaft of a building, the elevator rails (rails) can be fastened directly or indirectly onto a wall of the building. Such an elevator rail can, for example, serve as a guide rail for an elevator car, or for a counterweight of the elevator system. Such elevator rails usually extend over the entire travel distance of the elevator, which in many cases can approximate to the height of the building. Here the elevator rails are strongly fastened to the building such that lateral guidance forces can be safely accommodated. However, the height of the building can alter over time. There are a number of possible reasons for this. For example, a building can shrink after completion as a result of the concrete drying out and building settlement. Alterations in the height of buildings can also be caused by alterations in temperature and solar radiation.

Alterations in the height of the building as a rule result in alterations in length that are not compensated for relative to the metallic elevator rails. This means that the guide rails in the elevator shaft thus move relative to the building. If, for example, the building shrinks, the guide rails grow relative to the building. In order to avoid deformations in rail sections between fastening points as a result of such relative length alterations, the fastening points for a rail, in particular a guide rail, must be embodied in such a way that length compensation is enabled. At the same time, however, it must also be ensured that the rail is fastened in such a way that it meets the relevant requirements, such that, for example, in the case of a guide rail, the guidance forces can be accommodated.

SUMMARY

An object of the invention is to specify a rail foot holder, which serves to fasten a rail of an elevator system in an elevator shaft, and a method for fastening a rail of an elevator system in an elevator shaft by means of at least one rail foot holder of an improved configuration. In particular, an object of the invention can be to specify such a rail foot holder and such a method so as to permit improved fastening, in particular in which a simplified adjustment and installation is enabled, wherein in the installed state both a relative displacement of the rail along its extent is possible, and any movement or rotation transversely to, or around, its extent is prevented.

In what follows solutions and proposals for an appropriate configuration are specified, which concern a rail foot holder and a method that is executed with at least one rail foot holder, and which achieve at least elements of the object set. In addition, advantageous additional or alternative developments and designs are specified or described.

In one solution, a rail foot holder, which serves to fasten a rail in an elevator shaft, can be formed with a contact body, which can be arranged in the elevator shaft, and at least one holding device, wherein a contact plane for a foot of the rail is provided by the contact body, wherein the holding device has a holding head, wherein a first side part of the rail foot can be arranged between the holding head of the holding device and the contact plane for purposes of fastening the rail, wherein in the course of the fastening of the rail a holding dimension between the holding head of the holding device and the contact plane can be altered to compensate for tolerances on the first side part of the rail foot, wherein for purposes of reducing the holding dimension the holding head of the holding device can be rotated in a direction of rotation around an axis of rotation of the holding device into a fastening position, and wherein a side of the holding head of the holding device facing towards the contact plane in at least one fastening region extending in the direction of rotation around the axis of rotation of the holding device, on which at least indirect contact is enabled between the holding head of the holding device and the first side part of the rail foot, is configured with a sloping rise counter to the direction of rotation.

Here the rail (elevator rail) is not a component of the rail foot holder. In particular, the rail foot holder can also be manufactured and sold independently of a rail or other components of an elevator system. The rail foot holder is configured such that an improved arrangement and/or installation of the rail with respect to a particular arrangement of the rail is enabled. In this regard, in particular, in the course of the installation of the elevator system, in which one or a plurality of rails are fastened in the elevator shaft, preferably by way of a plurality of rail foot holders in each case, an improved adjustment can be made with respect to, for example, a fastening of the rail that is free of play. In particular, this makes it possible to compensate for manufacturing tolerances on the rail, which can especially affect the material thickness of a rail foot. For example, the material thickness of the rail foot can vary from rail section to rail section. If such rail sections are then joined together to form the rail, a slightly different adjustment of the holding dimension can then be required in each section. This adjustment can be carried out very easily by a fitter when the rail is installed in the elevator shaft.

In another solution, a method for fastening a rail of an elevator system in an elevator shaft by means of at least one inventive rail foot holder can be specified, wherein the contact body is fixedly arranged in the elevator shaft, wherein a first side part of the rail foot is arranged between the holding head of the holding device and the contact plane defined by the contact body, and wherein the holding head is rotated around the axis of rotation of the holding device so as to reduce the holding dimension between the holding head of the holding device and the contact plane.

Needless to say, the designations "first side part" and "second side part" of the rail foot are used here to refer to the two side parts of the rail foot, without any determination thereby being made as to which of the two side parts is to be designated as the first or second side part. In particular, the configuration of the rail foot can be modified in such a way that the two side parts of the rail foot are referred to as the first and second side parts in an inverted manner. In terms of design, this can correspond to a reflection of the rail foot holder on a suitable design plane. In principle, however, mirror-symmetrical designs of the rail foot holder are also conceivable in this respect. The same applies to the designations "holding device" and "other holding device" or "first and second holding devices".

A particular feature of the proposed configuration is that it allows the head of the holding device to be adjusted to the dimensions of the rail foot, which are in general subject to tolerances, without disassembling the holding device, which in the context of this application is referred to as "adjustment without disassembly". Accordingly, in a possible further development, "fastening without disassembly" is possible by enabling an adjustment to the holding device, or an approach of the holding device towards the rail foot, which can be achieved, for example, by means of a suitable elongated hole. In addition, it is possible to implement a configuration in an advantageous manner, in which the holding head can be locked or fixed in the desired position by a single step in the installation, for example by tightening a screw, in terms of both adjustments without disassembly, and fastening without disassembly. Possible embodiments for the adjustment without disassembly and the fastening without disassembly are also explained in more detail in what follows, with the aid of the description of the figures.

It is therefore advantageous that the holding head of the holding device can be rotated, in the direction of rotation around the axis of rotation of the holding device, into the fastening position for an adjustment so as to reduce the holding dimension. It is also advantageous that in the course of the adjustment used to reduce the holding dimension, the holding head of the holding device is turned in the direction of rotation around the axis of rotation of the holding device into the fastening position. This enables an adjustment without disassembly.

A fastening without disassembly is also possible for purposes of fastening the rails, that is to say, in the course of fastening the rails.

It is also advantageous that the holding head, in the course of an adjustment serving to reduce the holding dimension, in particular in the course of an adjustment without disassembly, can be rotated around the axis of rotation, in another direction of rotation oriented counter to the direction of rotation, into a fastening position, and that the side of the holding head facing towards the contact plane in another fastening region, extending around the axis of rotation in the other direction of rotation, on which an at least indirect contact between the holding head and the first side part of the rail foot is enabled, is configured with a sloping rise counter to the other direction of rotation. By this means the fitter can reduce the holding dimension in the course of adjustment of the latter, regardless of whether for purposes of adjustment he rotates the holding head in the direction of rotation, or in the other direction, namely in the other direction of rotation. As a result ergonomic advantages also ensue, as the fitter can select the most ergonomically favorable direction of rotation for either the right hand or the left hand. In this respect, the size and configuration of the holding head, in particular on its side facing away from the contact plane, can be configured in such a way that, for example, an advantageous gripping with a glove is enabled.

It is advantageous that the holding device can be adjusted relative to the base body in such a way that a distance between the axis of rotation of the holding device and another holding device, between which the rail foot can be fastened, can be altered. In the course of an installation, before reducing the distance between the axis of rotation of the holding device and the other holding device, the rail can be positioned with its rail foot between the two holding devices; the holding device can then be adjusted relative to the base body such that the distance between the axis of rotation of the holding device and the other holding device is reduced until the desired fastening position for the axis of rotation is achieved, and the holding head can then be rotated around the axis of rotation until the suitable holding dimension is adjusted. By this means a fastening of the rail by means of the holding device is enabled without disassembly. In one possible configuration, it is advantageous that the contact body has an elongated hole for this purpose, into which a bolt of the holding device is guided. This configuration then enables the holding device to be adjusted relative to the contact body.

It is advantageous that the holding head of the holding device has an end face facing towards the contact body, which for purposes of fixing the holding head relative to the contact body can be forced against the contact body by means of a fastening means of the holding device. Such a fastening means can, for example, have a threaded bolt, which is fastened to the contact body by means of a nut and washer. By this means the possibility ensues for the threaded bolt to also serve as a bolt, which, for example, is guided in an elongated hole of the contact body, so as to enable the holding device to be adjusted relative to the contact body.

Here it is furthermore of advantage for the end face of the holding head of the holding device facing towards the contact body to be configured as a structured end face. The structured end face can aid the fixing function by reducing the influence of dirt, liquids such as oil, and similar. For example, it is possible to provide grooves in the end face of the holding head facing towards the contact body. It is particularly advantageous here if such grooves are configured as grooves that run radially with respect to the axis of rotation of the holding device, in the end face of the holding head facing towards the contact body. A combination of such measures is also conceivable. For example, grooves, in particular, grooves running radially with respect to the axis of rotation, can also be combined with other structural elements on the end face to form a structured end face. The structured end face is preferably configured in such a way that the end face of the holding head is gripped by the contact body in the course of fixing, that is to say, in the course of the tightening of threaded bolts. This prevents any inadvertent rotation of the holding head in its installed state. The said grooves, which run radially with respect to the axis of rotation of the holding device and can be used to configure the structured end face, fulfil this criterion.

Furthermore, it is advantageous for another holding device to be provided, and for the other holding device, that is to say, an axis of rotation of the other holding device, to be arranged in a fixed manner on the contact body. With this configuration, it can in particular be possible that the holding device can only be adjusted relative to the contact body in such a way that the axis of rotation of the holding device can be adjusted relative to the contact body. If it is necessary to position the other holding device relative to the rail, this can be achieved in an advantageous manner by adjusting the contact body relative to a fastening body. In the course of the installation, the other holding device is first brought into the desired position in the elevator shaft. The contact body can then be fixed in its position, which is enabled, for example, by an appropriate fastening to the fastening body. The holding device can then be adjusted relative to the other holding device. In the last step, a holding head of the holding device and a holding head of the other holding device can then be adjusted.

Thus it is also advantageous if another holding device is provided which has a holding head, wherein a second side part of the rail foot can be arranged between the holding head of the other holding device and the contact plane for purposes of fastening the rail, wherein another holding dimension between the holding head of the other holding device and the contact plane can be altered in the course of the fastening of the rail to compensate for tolerances on the second side part of the rail foot, wherein in the course of an adjustment serving to reduce the other holding dimension the holding head of the other holding device can be rotated into a fastening position in one direction of rotation around an axis of rotation of the other holding device, and wherein a side of the holding head of the other holding device facing towards the contact plane, in at least one fastening region extending in the direction of rotation around the axis of rotation of the holding device, in which fastening region an at least indirect contact between the holding head of the other holding device and the second side part of the rail foot is enabled, is configured with a sloping rise counter to the direction of rotation. This configuration enables, for example, steps in the installation in accordance with which the rail foot is fastened on both sides at least essentially free of play. Here it is also conceivable that the holding dimension and the other holding dimension differ, if this is necessary in the application in question, in particular as a result of differing tolerances on the rail foot.

It is advantageous for the holding head of the holding device, or the holding head of the other holding device, on the side facing towards the contact plane, to be configured in the at least one fastening region with a continuously sloping rise in the direction of rotation, or in the other direction of rotation. As a result, the sloping rise does not undergo any abrupt alteration. This configuration can therefore relate to the holding head of the holding device and/or to the holding head of the other holding device. Furthermore, with respect to the head of the holding device, or the head of the other holding device, this can apply to only one fastening region, or to the only fastening region, or, if two fastening regions are provided, to both fastening regions. A preferred configuration of the non-abruptly altering sloping rise is a continuously extending sloping rise. Here a variety of designs are conceivable.

For example, the sloping rise can be configured in such a way that the holding dimension alters linearly with the angle of rotation, in the course of rotation in the direction of rotation, or in the other direction of rotation.

Furthermore, it is advantageous for a fastening body to be provided, which can be fastened in a fixed manner in the elevator shaft, and for the contact body to be able to be connected to the fastening body. It is also advantageous here if the contact body can be connected to the fastening body in a plurality of possible connecting positions. Discrete and/or continuous adjustment options can be implemented. After the fastening of the fastening body in a fixed manner, this then enables an advantageous adaptation of the position of the contact body to the nominal position defined for the fastening of the rail.

It is also advantageous for a cylindrical sliding surface to be provided on the holding head, or the other holding head, on which a contact between the first side part or the second side part of the rail foot and the holding head is enabled, for purposes of guiding the rail foot when the rail is fastened. If, for example, relative length alterations occur between the rail and the building, a longitudinal compensation along the extent of the rail is required, which here is held by the rail foot holder. At the same time, however, the rail should also remain movable along its extent relative to the rail holder. In particular, it is appropriate to avoid any build-up of mechanical stresses along the extent of a rail. In addition to a fastening, implemented by way of the holding dimension, or the other holding dimension, that is essentially free of play, but also virtually free of stress, this is enabled by reducing the holding friction between the holding head and the rail.

It is therefore also advantageous for the sliding surface to be formed on a reduced-friction coating of the holding head, or the other holding head, which, among other properties, reduces the static friction in this regard. In a modified configuration, it is accordingly advantageous for an at least approximately hollow cylindrical sliding ring to be mounted on the sliding surface of the holding head, or the other holding head. For purposes of guiding the rail foot, a contact between the first side part or the second side part of the rail foot and the sliding ring can then be enabled.

By this means the respective holding dimension can be precisely adjusted in accordance with a local rail foot thickness by means of the fastening regions inclined around the axis of rotation. This enables rail tolerances, especially tolerances on the side parts of the rail foot, to be absorbed. In addition, a lateral in-feed, for example by means of a lateral elongated hole, is possible in the contact body. This lateral in-feed, if necessary in combination with an ability to position the contact body in the elevator shaft, enables a precise lateral guide for the rail to be adjusted. A lubricant, a sliding layer and/or (in the lateral direction) a sliding ring, can be provided on the contact surfaces that occur. This avoids, in particular, any length compensation that occurs in a delayed and indefinite manner timewise, and then with a kind of jolt.

Preferred examples of embodiment of the invention are explained in more detail in the following description with the aid of the accompanying figures.

DETAILED DESCRIPTION

Figure 1:
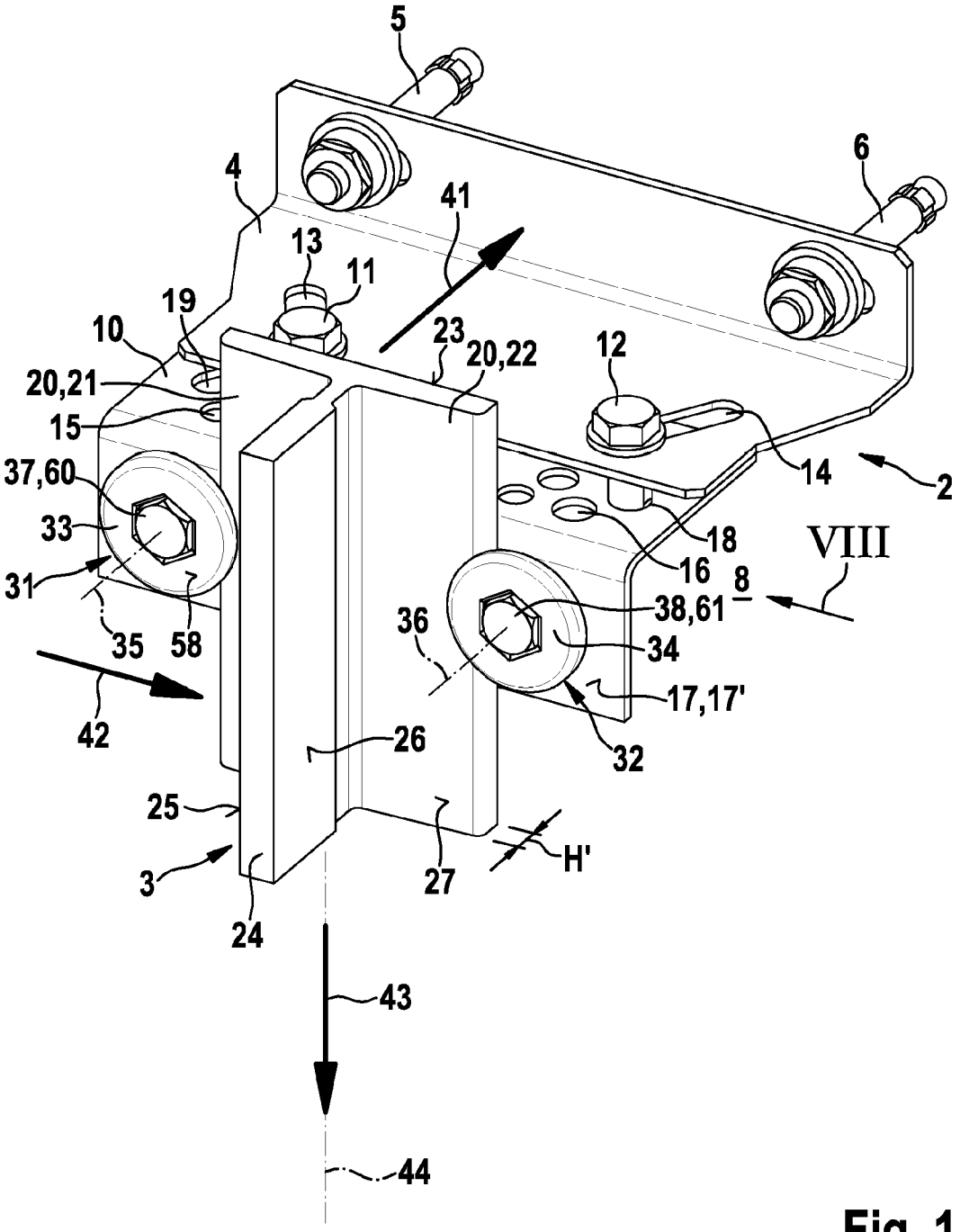
FIG. 1 shows a rail foot holder and a short piece of a rail in a spatial presentation corresponding to an example of embodiment of the invention.

FIG. 1 shows a rail foot holder 2 and a rail 3 for an elevator system 1 (FIG. 7) in a spatial presentation corresponding to an example of embodiment. To simplify the presentation, only a short piece of the rail 3 is shown here. The rail foot holder 2 has a fastening body 4, which can be connected to a wall 7 of an elevator shaft 8 with a masonry wall 9 (FIG. 7) by way of fastening means 5, 6, in particular fastening wall plugs 5, 6.

Furthermore, the rail foot holder 2 has a contact body 10, which can be connected in a suitable manner to the fastening body 4. In this example of embodiment, connecting means 11, 12 are provided, which enable the contact body 10 and the fastening body 4 to be connected to each other. Such connecting means 11, 12 can be implemented, for example, in terms of bolts, nuts and washers. In this example of embodiment, a plurality of connecting positions are hereby possible. This means that if the fastening body 4 is already fixed to the masonry wall 9, degrees of freedom for the positioning of the contact body 10 in the elevator shaft 8 still exist.

In this example of embodiment, elongated holes 13, 14 in the fastening body 4, and elongated holes 18, 19 in the contact body 10, are used in an exemplary manner for the implementation of a plurality of connecting positions. Furthermore, in this example of embodiment, a plurality of bores 15, 16 are also implemented in the contact body 10, wherein only bores 15, 16 are designated, so as to simplify the presentation. In a modified configuration, additional or alternative holes can be provided on the fastening body 4. Furthermore, only elongated holes 18, 19, or only bores 15, 16, can also be provided on the contact body 10. In addition, more than two elongated holes 13, 14, 18, 19, and/or a different number of bores 15, 16 can optionally be provided on the fastening body 4, and/or on the contact body 10. This makes it possible to connect the fastening body 4 with the contact body 10 in a plurality of connecting positions with respect to the particular application. By this means a discrete adjustment and/or a variable adjustment can be enabled. This results in advantages with regard to installation, as the fitter can then easily align the contact body 10 with reference to its nominal position.

The contact body 10 mounted in this way in the elevator shaft 8 defines a contact plane 17, which in this example of embodiment is determined by an end face 17' on the contact body 10. In a modified configuration, however, an additional layer, in particular a lining, can also be provided on the end face 17', on which the actual contact plane 17 is then located.

The rail 3 has a rail foot 20 with side parts 21, 22. In this example of embodiment, the side part 21 is referred to as the first side part, while the side part 22 is then referred to as the second side part.

The rail foot 20 also has a lower side 23, which faces the end face 17' of the contact body 10, and at least partially abuts against the contact plane 17. The rail foot 20 has an upper side 27 of the rail foot 20, which faces away from its lower side 23. Furthermore, the rail 3 has a rail head 24 on which tracks 25, 26 are formed. The tracks 25, 26 can serve as brake tracks and/or guide tracks 25, 26, for example, depending on the function of the rail 3.

The rail foot holder 2 has holding devices 31, 32. Here the holding device 31 associated with the first side part 21 of the rail foot 20 is referred to as the first holding device, while the holding device 32 associated with the second side part 22 is referred to as the second holding device 32. The first holding device 31 serves in the installed state to hold the first side part 21 against the contact plane 17. The second holding device 32 serves in the installed state to hold the second side part 22 against the contact plane 17. The first holding device 31 has a holding head 33. The second holding device 32 has a holding head 34. An axis of rotation 35 is defined for the first holding device 31. An axis of rotation 36 is defined for the second holding device 32. The holding head 33 can in principle be rotated around the axis of rotation 35. The holding head 33 can be fixed in a rotational position ensuing from the installation by means of a fastening means 37 of the first holding device 31. Correspondingly, the holding head 34 of the second holding device 32 can in principle be rotated and fixed in a rotational position resulting from the installation by means of a fastening means 38 of the second holding device 32.

For purposes of describing the example of embodiment of the rail foot holder 2, reference is made to a first direction 41, a second direction 42 and a third direction 43, which in each case are oriented at right angles to one another. In this example of embodiment, the first direction 41 is oriented at right angles to the contact plane 17. The second direction 42 and the third direction 43 are oriented parallel to the contact plane 17. Here the second direction 42 is oriented at right angles to the tracks 25, 26 of the rail head 24, while the direction 43 is oriented along an extent 44 of the rail 3 through the elevator shaft 8, when the rail 3 is fastened in the elevator shaft 8 by way of the rail foot holder 2 after the installation in the elevator shaft 8.

In this example of embodiment, the axis of rotation 36 of the second holding device 32 is fixed with respect to the contact body 10. The axis of rotation 35 of the first holding device 31 can be displaced (only) in the second direction 42, if the fastening means 37 is released. A possible implementation is described with the aid of FIG. 4.

For an installation, the holding head 33, or more particularly, the axis of rotation 35 of the first holding device 31, in contrast to the installation position shown, is initially located in an initial position in which the holding head 33 is located at a greater distance, in the opposite direction to the second direction 42, from the holding head 34 of the second holding device 32. In the initial position the distance between the holding heads 33, 34 is sufficiently large such that the rail foot 20 of the rail 3 can be inserted between the holding heads 33, 34 in the first direction 41. The rail 3 can then be moved with its rail foot 20 in the second direction 42 and mounted in the holding head 34 of the second holding device 32. In a modified configuration, the holding head 34, or more particularly, the axis of rotation 36, of the second holding device 32 can also be adjusted relative to the second holding device 32, such that the rail foot 20 only has to be placed against the contact plane 17 in the first direction 41.

The holding head 33 of the first holding device 31 is then adjusted in the second direction 42. In the position shown, the first side part 21 is then mounted between the holding head 33 of the first holding device 31 and the contact plane 17. The second side part 22 of the rail foot 20 is mounted between the holding head of the second holding device 32 and the contact plane 17.

Figure 5:
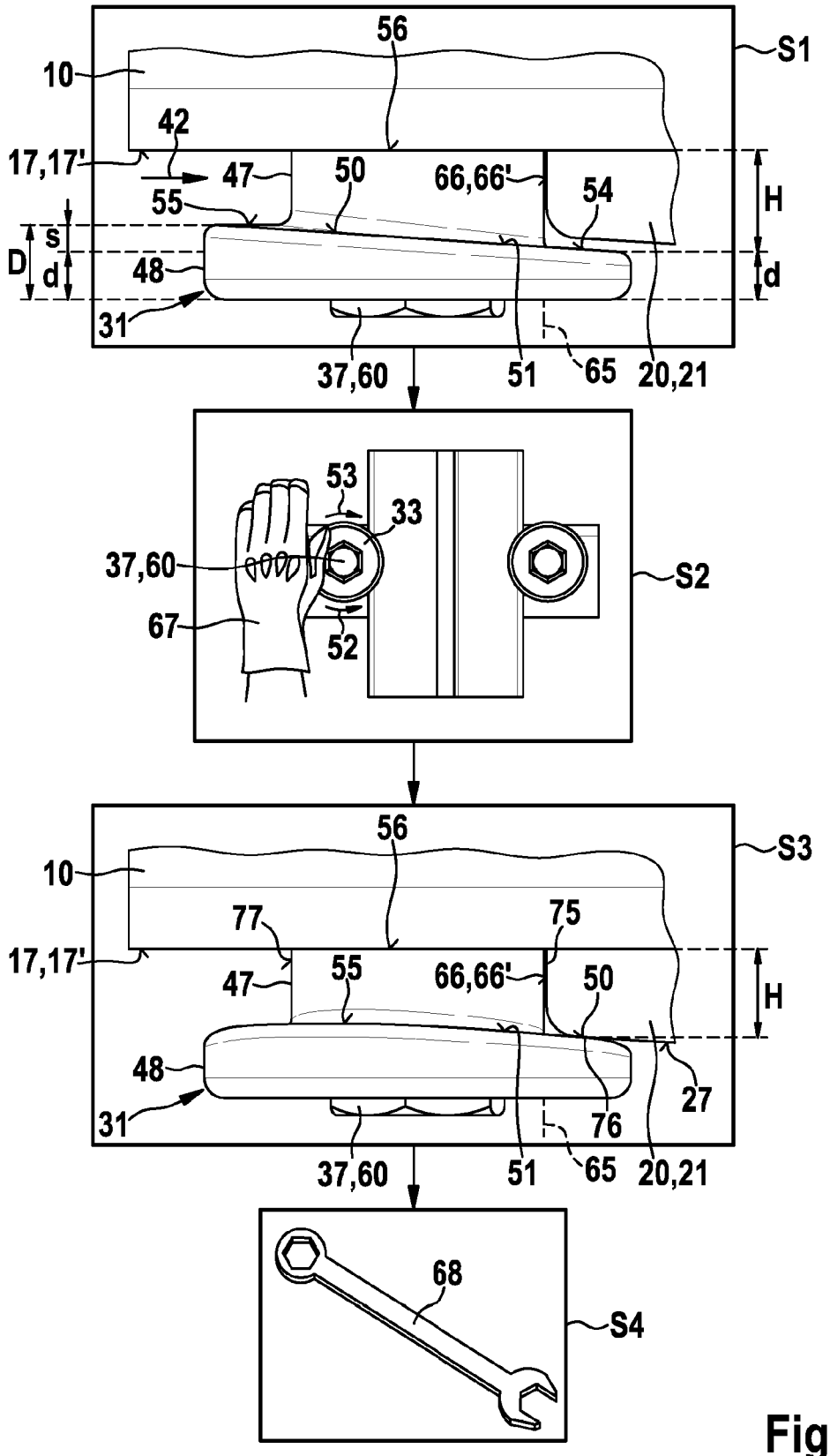
FIG. 5 shows in a number of diagrams a possible installation sequence in which the rail foot holder shown in FIG. 1 can be used to fix the rail in an elevator shaft, for purposes of explaining a method corresponding to an example of embodiment of the invention, and for purposes of explaining the function of the rail foot holder.

The other installation procedure is also described in more detail in FIG. 5.

Figure 7:
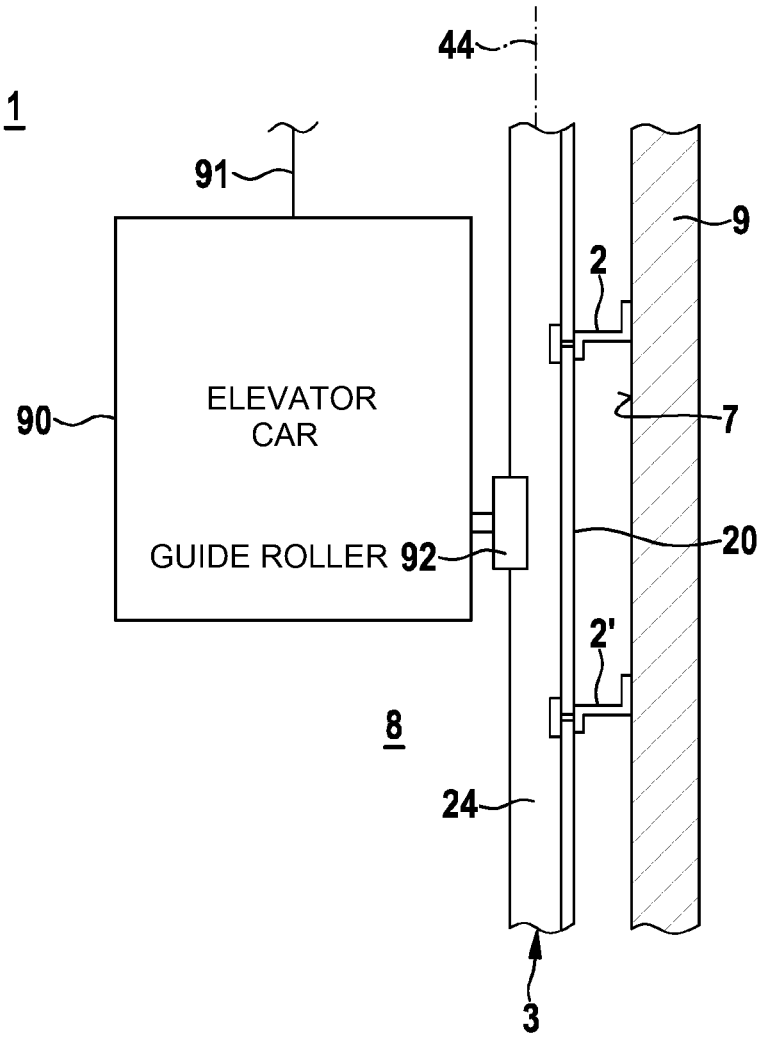
FIG. 7 shows an elevator system, in which at least one rail is fastened with the rail foot holder shown in FIG. 1.

After installation, the rail 3 is held free of play, but as free of stress as possible, in and counter to the first direction 41. Furthermore, the rail 3 is held free of play, but as free of stress as possible, in and counter to the second direction 42. In contrast, there is a degree of freedom with regard to the third direction 43. This enables the rail 3 to be moved along its extent 44, for example to enable relative length compensation with respect to the masonry wall 9 (FIG. 7).

Figure 2:
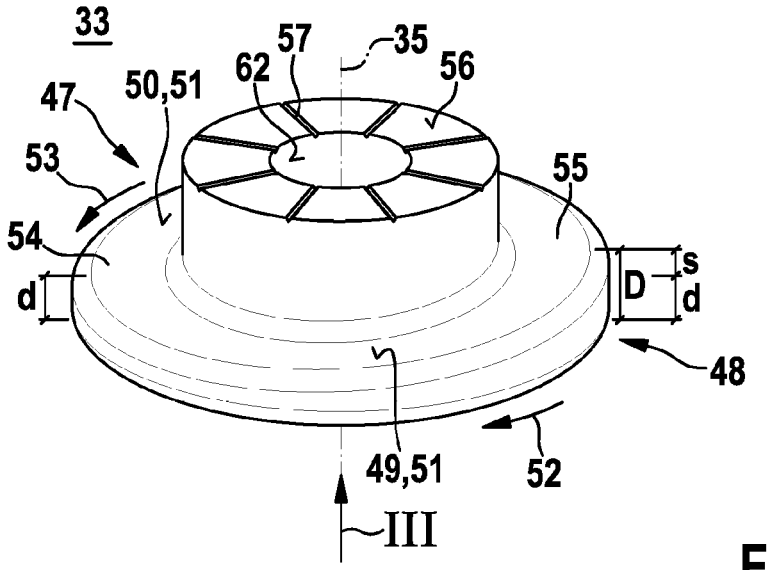
FIG. 2 shows a holding head for a holding device of the rail foot holder shown in FIG. 1 in a spatial presentation.

FIG. 2 shows the holding head 33 for the holding device 31 of the rail foot holder 2 shown in FIG. 1 in a spatial presentation. The holding head 34 can be configured in a manner corresponding to that for the holding head 33. The holding head 33 has a hollow cylindrical spacer 47 and a plate-shaped holding part 48. Fastening regions 49, 50 are configured on the holding part 48 of the holding head 33. The fastening regions 49, 50 are formed on one side 51 of the holding part 48 of the holding head 33, which in the mounted state faces towards the contact plane 17. In a modified configuration, only one fastening region 49 can be provided.

The fastening region 49 extends in one direction of rotation 52 around the axis of rotation 35. The other fastening region 50 extends in the other direction of rotation 53 around the axis of rotation 35. The direction of rotation 52 and the other direction of rotation 53 are oriented counter to one another.

In a region 54, where the two fastening regions 49, 50 meet, the plate-shaped holding part 48 has a minimum thickness d. In a region 55, which is opposite the region 54 with respect to the axis of rotation 35, and in which the fastening regions 49, 50 also meet, the plate-shaped holding part 48 has its maximum thickness D. The maximum thickness D ensues from the minimum thickness d plus a sloping rise s. The sloping rise s ensues from a rotation in the direction of rotation 52, or in the other direction of rotation 53, through 180°.

In this way the holding head 33 is configured with a sloping rise s starting from the region 54 counter to the direction of rotation 52, or counter to the other direction of rotation 53.

In the course of installation, the holding head 33 is first oriented, at least approximately, with respect to its axis of rotation 35, so that the first side part 21 is located between the region 54 of the side 51 of the holding head 33 and the contact plane 17. The fitter can then rotate the holding head 33 around its axis of rotation 35, as a result of which a holding dimension H is reduced, as described with the aid of FIG. 5. With this configuration, the fitter is not restricted to one direction of rotation. That is to say, he can achieve a fastening either in the direction of rotation 52 or in the other direction of rotation 53.

The holding head 33 has an end face 56 facing towards the contact plane 17, that is to say, the end face 17' of the contact body 10. In the installed state, the end face 56 of the holding head 33 provided on the spacer 47 is pressed against the contact body 10 in such a way that the holding head 33 is fixed against rotation around the axis of rotation 35, and in this example of embodiment against displacement along the second direction 42. The fastening force is hereby applied by way of the fastening means 37, 38 (FIG. 1).

To aid the fixing, the end face 56 is configured as a structured end face 56. In this example of embodiment, grooves 57 are formed in this regard on the end face 56 of the holding head 33, of which only the groove 57 is identified so as to simplify the presentation. In this example of embodiment, the groove 57 runs radially with respect to the axis of rotation 35 of the holding device 31. The end face 56 is in other respects configured such that the axis of rotation 35 is oriented at right angles to the end face 56. Other structural elements, in particular recesses, can also be configured in the end face 56 if so required.

Here the grooves 57 are one possible variant of the configuration of the recesses 57. Structuring the end face 56 has the advantage that dirt, and liquids such as oil, and similar, have a reduced influence on the fixing of the holding head 33 onto the contact body 10. In addition, the recesses 57 cause the end face 56 to lock into contact with the contact plane 17 when the fastening means 37, 38 are tightened. The holding head 33 is thus secured against any rotation.

Figure 3:
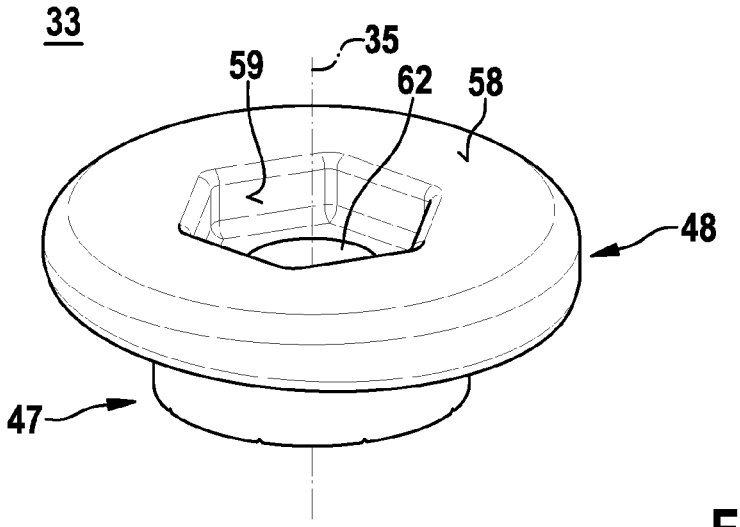
FIG. 3 shows the holding head shown in FIG. 2 from the viewing direction indicated by III.

FIG. 3 shows the holding head shown in FIG. 2 from the viewing direction indicated by III. The plate-shaped holding part 48 has an end face 58 facing away from the contact plane 17, that is to say, from the end face 17' of the contact body 10. From the end face 58 there extends a seating 59 for a head 60 of the fastening means 37. In this case the seating 59 is not rotationally symmetrical with respect to the axis of rotation 35. The head 60, which is also not rotationally symmetrical, fits into the seating 59 in such a way that the holding head 33 and the fastening means 37 are fixed such that they cannot rotate relative to one another in the installed state. The same applies to a head 61 of the fastening means 38 and the holding head 34. A depth of the seating 59 is less than a corresponding height of the head 61, 60 of the fastening means 37. Thus, when installing the rail foot holder 2 of the holding heads 33, 34, the holding head 33, 34 can be adjusted and/or held by means of a suitable key, and a nut 69 (FIG. 8) of the holding device 38 can then be tightened by means of a suitable tool 68 (FIG. 5).

In addition, the holding head 33 has an axial passage hole 62 through which a bolt (bolt section) 63 (FIG. 4) of the fastening means 37 extends in the installed state.

Figure 4:
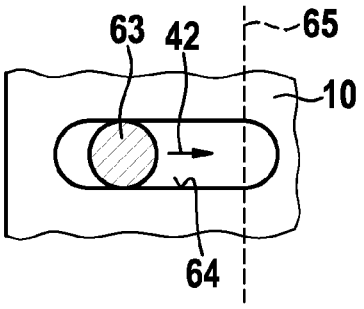
FIG. 4 shows a schematic presentation of a contact body with an elongated hole and a bolt of a holding device in accordance with a possible configuration of the rail foot holder shown in FIG. 1.

FIG. 4 shows a detail of the contact body 10 and the bolt 63 of the first holding device 31 in a cross-sectional detail corresponding to a possible configuration of the rail foot holder 2 shown in FIG. 1. The bolt 63, or bolt section 63, is guided such that it can move in the second direction 42 in an elongated hole 64 of the contact body 10. A dashed line 65 illustrates a possible nominal position for a stop of the bolt 63 on the first side part 21 of the rail foot 20 in the installed state. Since the dashed line 65 cuts through the elongated hole 64, a certain tolerance compensation is enabled with respect to the configuration of the rail foot 20.

FIG. 5 shows in a number of diagrams a possible installation sequence in which the rail foot holder 2 shown in FIG. 1 can be used to fix the rail 3 in an elevator shaft. This is to explain a method corresponding to an example of embodiment of the invention, and to explain the function of the rail foot holder 2. The individual diagrams show steps S1, S2, S3, S4, which can be executed in the course of such an installation.

In step S1, the holding device 31 is firstly adjusted onto the first side part 21 of the rail foot 20. The position of the dashed line 65 shown in FIG. 4 is also illustrated, wherein the relevant stop 66 is now implemented on the first side part 21 by a side 66' of the first side part 21.

If the holding device 31 with its hollow cylindrical spacer 47 hits the stop 66, then the maximum possible holding dimension H between the region 54 on the side 51 of the holding device 48 and the contact plane 17, that is to say, the end face 17' of the contact body 10, first ensues as the initial holding dimension H for the installation. The holding dimension H between the region 54 and the contact plane 17 is preferably specified in such a way that a greater or lesser play remains for the rail foot 20 with respect to all possible production-related tolerances of the rail foot 20. This means that the desired fastening, free of play, but also free of stress, is first achieved in step S2.

In step S2, the fitter turns the holding head 33 in the first direction of rotation 52, or in the other direction of rotation 53. This is illustrated by a hand 67 of the fitter. In the course of this installation process, the holding dimension H is reduced. The rotation in the direction of rotation 52, or the other direction of rotation 53, takes place until a fastening is achieved that is free of play, but also free of stress, as shown in step S3. Hereby there ensues a holding dimension H, which allows a fastening, free of play, of the first side part 21 of the rail foot 20 between the fastening region 50 selected here as an example, and the contact plane 17, that is to say, the end face 17', of the contact body 10. In this example of embodiment, this corresponds to a rotation of the holding head 33 in the direction of rotation 52. As a result, the region 55 moves closer to the stop 66, that is to say, closer to the dashed line 65. Thus, part of the available sloping rise s has been used so as to reduce the holding dimension H to the desired value.

In step S4, the holding head 33 is then fixed relative to the contact body 10. Here the head 60 of the fastening means 37 is fixed by the fitter using a suitable tool 68, or by hand 67. A nut 69 (FIG. 8) of the holding device 38 can then be tightened with the tool 68, or an additional tool corresponding to the tool 68.

Thus, with the rail foot holder 2 in accordance with the example of embodiment an adjustment, in particular an adjustment of the holding dimension H with respect to the rail foot 20, is possible without disassembly. Accordingly, it is possible to fix the rail foot 20 in the elevator shaft 8 by means of the rail foot holder 2 without disassembly. Here the rail foot holder 2 can already be pre-installed on delivery, so that in particular the holding devices 31, 32 are already located on the contact body 10 in the pre-installed state. Any disassembling of the holding devices 31, 32 for purposes of adjustment and/or fastening is then not necessary. Another holding dimension H' can be adjusted in a corresponding manner on the holding head 34 of the second holding device 32. To simplify the presentation, the additional holding dimension H' is illustrated in FIG. 1 with respect to the second side part 22 of the rail foot 20.

Needless to say, this does not exclude the possibility that the rail foot holder 2 can also first be assembled in the course of installation, that is to say, after delivery to the installation site.

After step S3 and the fastening in step S4, contacts 75, 76 ensue between the rail foot 20 and the holding head 33 of the first holding device 31. The contact 75 here ensues between the first side part 21 in the region of its stop 66, that is to say, its side 66', and the hollow cylindrical spacer 47. The contact 76 ensues between the fastening region 50, or the fastening region 49, and an upper side 27 of the rail foot 20, which faces away from its lower side 23. A sliding surface 77 is preferably provided on the hollow cylindrical spacer 47 in order to avoid static friction at the contact 75 in the course of a relative displacement of the rail foot 20 along its extent 44 with respect to the building, in particular the masonry wall 9. A suitable lubricant can be applied to the sliding surface 77. The same applies to the contact 76. This means that the fastening regions 49, 50 should preferably be as smooth as possible.

In a modified configuration, it is also possible that the sliding surface 77 and/or the fastening regions 49, 50 are formed on or with a reduced-friction coating.

Figure 6:
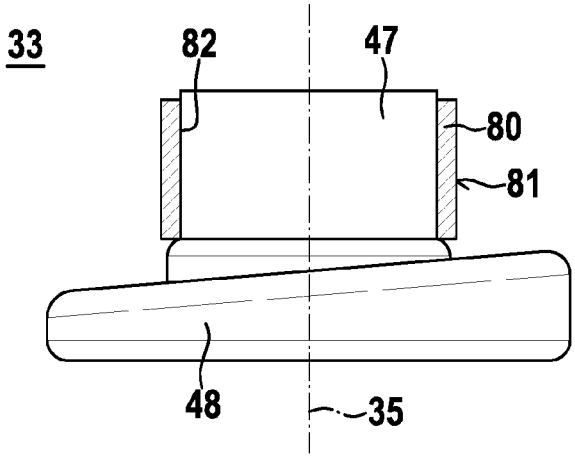
FIG. 6 shows the holding head shown in FIG. 2 in accordance with another example of embodiment of the invention.

FIG. 6 shows the holding head shown in FIG. 2 in accordance with another example of embodiment. In this example of embodiment, a sliding ring 80 is mounted on the hollow cylindrical spacer 47 of the holding head 33. The contact 75 (FIG. 5) is then made between an outer face 81 of the sliding ring 80 and the side 66' of the first side part 21 of the rail foot 20. Here the sliding ring 80 can rotate relative to the holding head 33 around the axis of rotation 35. The bearing 82 of the sliding ring 80 on the hollow-cylindrical spacer 47, here designed as a sliding bearing 82, can be lubricated with a suitable lubricant.

FIG. 7 shows a detail of the elevator system 1, in which the rail 3 is fastened in the elevator shaft 8 with the rail foot holder 2 shown in FIG. 1, together with another rail foot holder 2', in a schematic presentation. The elevator system 1 has an elevator car 90, which is suspended from a means of support 91. Furthermore, an example of a guide roller 92 is shown, by means of which the elevator car 90 is guided on the rail 3. Here the guide roller 92 interacts with the rail head 24 of the rail 3. Guidance forces essentially work in, or counter to, the second direction 42. In this respect, the rail 3 is reliably fixed by way of the holding heads 33, 34. Furthermore, the rail 3 is also reliably held on the masonry wall 9, that is to say, the wall 7 of the elevator shaft 8.

If the dimensions of the building alter as a result of building settlement, temperature-related alterations in length or similar, relative alterations in length can occur between the masonry wall 9 and the rail 3. Here a length compensation is enabled, since the degree of freedom of the rail 3 along its extent 44, that is to say, in, and counter to, the third direction 43, is essentially not restricted by the rail foot holders 2, 2'.

Figure 8:
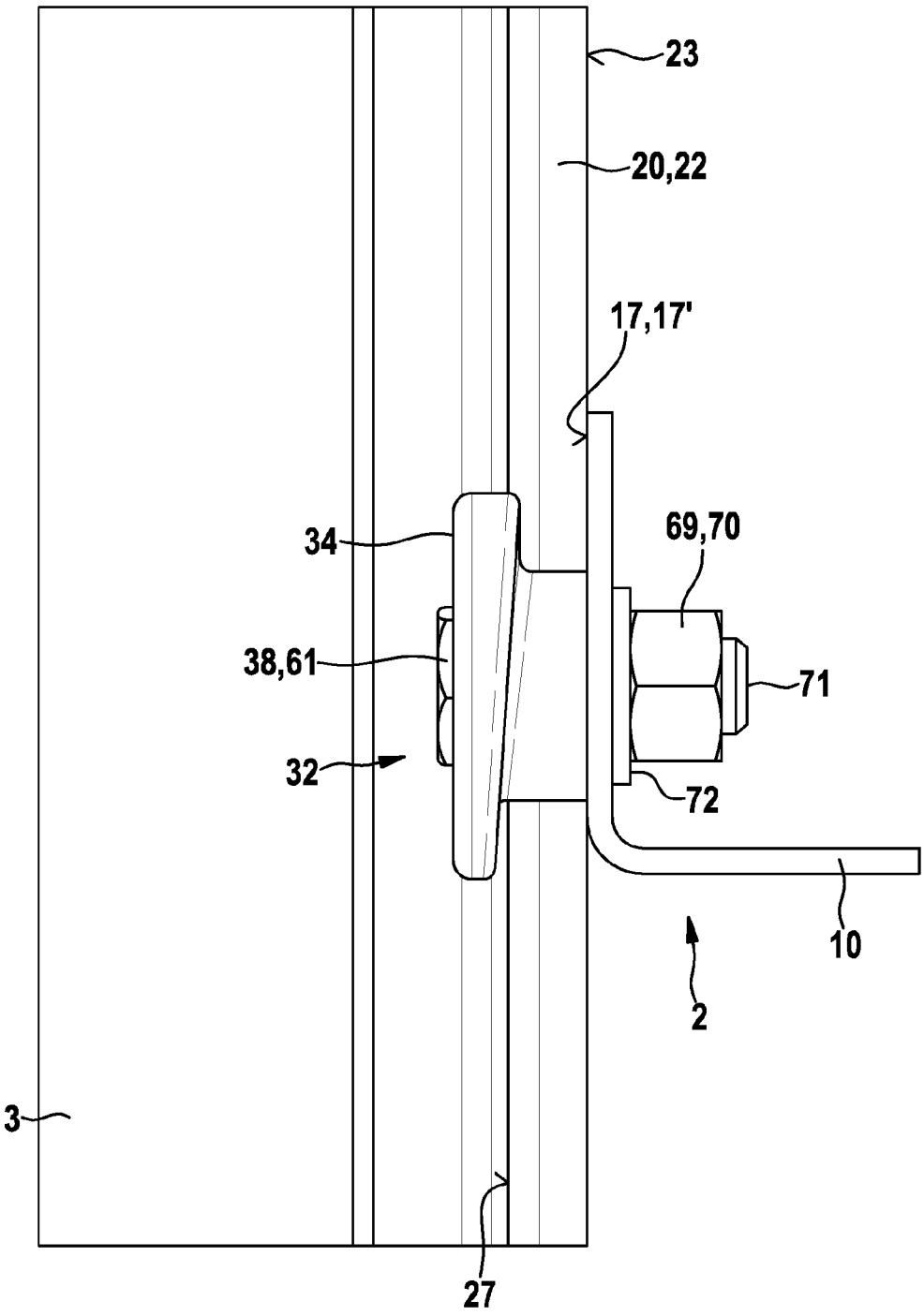
FIG. 8 shows the rail foot holder shown in FIG. 1 and the short piece of rail in a detail presented from the viewing direction indicated by VIII.

FIG. 8 shows the rail foot holder 2 shown in FIG. 1, and the rail 3, in a detail from the viewing direction indicated by VIII. Here the nut 70 is shown for the bolt 71, in particular the threaded bolt 71, of the second holding device 32. The threaded bolt 71 has the head 61. The nut 70 is tightened in step S4 (FIG. 5), while the head 61 and thus the holding head 34 is held in its position.

Another nut 69, which is configured like the nut 70, serves for the bolt 63, in particular the threaded bolt 63, wherein only one nut 69, 70 is shown as an example, so as to simplify the presentation. Other elements can also be used, in particular a washer 72.

The invention is not limited to the described example of embodiment and the described modifications.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A rail foot holder for fastening a rail of an elevator system in an elevator shaft comprising:

a contact body adapted to be arranged in the elevator shaft;

at least one holding device arranged on the contact body;

wherein the contact body defines a contact plane for a rail foot of the rail;

wherein the at least one holding device has a holding head;

wherein a first side part of the rail foot can be arranged between the holding head and the contact plane;

wherein during a fastening of the rail in the elevator shaft, a holding dimension between the holding head and the contact plane can be altered to compensate for tolerances on the first side part of the rail foot;

wherein for reducing the holding dimension, the holding head is rotatable in a direction of rotation around an axis of rotation of the at least one holding device into a fastening position; and wherein a side of the holding head, facing towards the contact plane in at least one fastening region extending in the direction of rotation around the axis of rotation, at which an at least indirect contact is enabled between the holding head and the first side part of the rail foot, is formed with a sloping rise counter to the direction of rotation.

2. The rail foot holder according to claim 1 wherein the holding head is rotatable around the axis of rotation in another direction of rotation into the fastening position, the another direction of rotation being counter to the direction of rotation, and wherein the side of the holding head facing towards the contact plane in another fastening region extending around the axis of rotation in the other direction of rotation, at which an at least indirect contact is enabled between the holding head and the first side part of the rail foot, is formed with a sloping rise counter to the other direction of rotation.

3. The rail foot holder according to claim 2 wherein the sloping rises each extend continuously counter to the respective direction of rotation.

4. The rail foot head according to claim 1 wherein the at least one holding device is adjustable relative to the contact body such that a distance between the axis of rotation of the at least one holding device and another holding device, between which holding devices the rail foot can be fastened, can be altered.

5. The rail foot holder according to claim 4 wherein the contact body has an elongated hole in which a bolt of the at least one holding device is guided.

6. The rail foot holder according to claim 4 wherein the another holding device is arranged on the contact body and is rotatable around an axis of rotation of the another holding device.

7. The rail foot holder according to claim 4 wherein the another holding device has a holding head, wherein a second side part of the rail foot can be arranged between the holding head of the another holding device and the contact plane, wherein during the fastening of the rail in the elevator shaft, another holding dimension between the holding head of the another holding device and the contact plane can be altered to compensate for tolerances on the second side part of the rail foot, wherein for reducing the another holding dimension, the holding head of the another holding device is rotatable in a direction of rotation around an axis of rotation of the another holding device into a fastening position, and wherein a side of the holding head of the another holding device, facing towards the contact plane in at least one fastening region extending in the direction of rotation around the axis of rotation of the another holding device, at which an at least indirect contact is enabled between the holding head of the another holding device and the second side part of the rail foot, is formed with a sloping rise counter to the direction of rotation.

8. The rail foot holder according to claim 1 wherein the holding head has an end face that faces towards the contact body, and wherein the at least one holding device includes a fastening means for fixing the holding head relative to the contact body by forcing the end face against the contact body.

9. The rail foot holder according to claim 8 wherein the end face of the holding head is at least one of formed as a structured end face and has grooves running radially with respect to the axis of rotation of the at least one holding device.

10. The rail foot holder according to claim 1 including a fastening body adapted to be fastened in the elevator shaft and wherein the contact body is adapted to be connected to the fastening body in each a plurality of selectable connecting positions.

11. The rail foot holder according to claim 1 wherein the holding head includes at least one sliding surface for contacting the rail foot.

12. The rail foot holder according to claim 11 wherein when the rail is fastened by the rail foot holder, contact is established between the first side part of the rail foot and the holding head on the at least one sliding surface for guiding the rail foot.

13. The rail foot holder according to claim 12 wherein the at least one sliding surface is formed on a reduced-friction coating of the holding head, or the at least one sliding surface is formed on a sliding ring mounted on the holding head.

14. A method for fastening a rail of an elevator system in an elevator shaft comprising the steps of:

providing at least one of the rail foot holder according to claim 1;

arranging the contact body of the at least one rail foot holder in the elevator shaft;

arranging a first side part of a rail foot of the rail between the holding head of the at least one holding device and the contact plane defined by the contact body; and rotating the holding head around the axis of rotation of the at least one holding device to reduce the holding dimension between the holding head and the contact plane.

15. The method according to claim 14 including to reduce the holding dimension rotating the holding head around the axis of rotation until the first side part of the rail foot is held free of play and free of stress between the holding head and the contact plane.

* * * * *